United States Patent [19]

Norton et al.

[11] 4,320,238

[45] Mar. 16, 1982

[54] HIGH DENSITY TURBINE FUEL

[75] Inventors: Richard V. Norton, Dublin; Steven C. Howe, Columbus, both of Ohio

[73] Assignee: Ashland Oil, Inc., Ashland, Ky.

[21] Appl. No.: 180,182

[22] Filed: Aug. 21, 1980

[51] Int. Cl.[3] ..... C07C 13/28

[52] U.S. Cl. ..... 585/14; 585/22; 585/253; 585/362; 149/109.4; 149/109.6; 149/120

[58] Field of Search ..... 585/14, 22, 253, 362; 149/109.4, 109.6, 120

[56] References Cited

U.S. PATENT DOCUMENTS

| | | | |
|---|---|---|---|
| 3,381,046 | 4/1968 | Cohen et al. | 585/362 |
| 4,059,644 | 11/1977 | Cannell | 585/14 |
| 4,086,284 | 4/1978 | Schneider et al. | 585/14 |
| 4,177,217 | 12/1979 | Janoski et al. | 585/14 |

*Primary Examiner*—Jacqueline V. Howard
*Attorney, Agent, or Firm*—William Kammerer

[57] ABSTRACT

A high density fuel composition having low temperature operational capability for propelling turbo-jet, limited volume missile systems consisting essentially of at least 95 weight percent exo-tetrahydrodicyclopentadiene (JP-10) and a correspondingly minor amount of a $C_3$–$C_7$ saturated hydrocarbon.

4 Claims, No Drawings

HIGH DENSITY TURBINE FUEL

BACKGROUND OF THE INVENTION

1. Field of the Invention

This invention relates to synthetically derived high density liquid hydrocarbon fuels.

2. Description of the Prior Art

High density liquid hydrocarbon fuels are characterized in having a net volumetric heat of combustion in excess of about 140,000 BTU per gallon. A high density or high energy fuel is essentially required for fueling turbojet and ramjet propelled limited volume missile systems. Beyond the need for a high energy content in order to maximize range performance of the missile, there are other requirements in the forefront depending, in the main, on the manner in which the missile is to be deployed. For instance, in the air-borne deployment of a missile where the latter is carried exteriorly of the aircraft, the fuel must exhibit the combination of a very low freeze point, high volatility and be reasonably fluid at the low temperatures encountered.

A high density fuel of the foregoing type does not occur in nature rather must be chemically synthesized. Essentially all of the current generation of such fuels commonly feature a norbornane moiety having an additional cyclic hydrocarbon appendage. A noteworthy fuel of the foregoing type is represented by the exo-stereo isomer of tetrahydrodicyclopentadiene which in commerce is generally referred to as JP-10. The latter is prepared by first hydrogenating dicyclopentadiene yielding the solid endo-isomer of the hydrogenated derivative. The endo structure is then isomerized in the presence of a catalyst to produce the exo-isomer almost quantitatively in a relatively pure form. Since JP-10 is derived from abundantly available raw materials coupled with the fact that the isomerization procedure is highly developed, such are the main factors why the product is regarded as a prime fuel.

Neat JP-10, however, fails as a universal fuel because of its flash point. The flash point of JP-10 is too low, although only marginally so, for ship or submarine launching operations; whereas, it is considerably higher than that required in air-borne deployment of the missile system. The object of this invention, accordingly, is that of modifying JP-10 in a manner whereby the flash point is substantially reduced without significantly diluting the high heat content associated with the fuel itself.

SUMMARY OF THE INVENTION

In accordance with the present invention, a high density fuel composition is provided which is essentially completely composed of JP-10. The contemplated compositions further contain from 0.1-weight percent of a $C_3$–$C_7$ and more preferably a $C_3$–$C_5$ cyclic or acyclic alkane as a flash point depressant. Neat JP-10 exhibits a flash point of 131±1° F. and a volumetric heat content of 141,880 BTU per gallon. Depending on the selection of the indicated depressants and the amount thereof utilized, the flash point of a fuel composition in accordance with this invention can be extensively varied ranging to 35° F. or lower while maintaining an overall heat value of at least. 140,000 BTU per gallon.

DESCRIPTION OF THE PREFERRED EMBODIMENTS

As indicated previously, JP-10 is a commercially available product. However, for a more complete understanding of the best mode contemplated for carrying out the present invention, it will be desirable to comment briefly on the process applicable for producing this fuel. Further details regarding this process can be found in U.S. Pat. No. 3,381,046. The first step involved is that of completely hydrogenating dicyclopentadiene to provide the endo-stereo isomer of the tetrahydro derivative. Generally hydrogenation is carried out in two stages. In the first stage the 8,9 positions of the dimer are hydrogenated at a temperature generally in the order of about 120° C. The dihydro derivative is relatively thermally stable, thus permitting the use of a substantially higher temperature in the second stage, viz., in the order of about 215° C. Hydrogenation is carried out in the second stage to the extent whereby the resultant tetrahydro derivative exhibits a melting point of at least about 70° C. Hydrogenation pressure conditions range from about 5–15 atmospheres.

In the second step of the process the endo isomer of the tetrahydro derivative is isomerized to the exo form. The crude hydrogenation product or an appropriate distilled fraction thereof, rich in the exo-isomer content, can alternatively be subject to isomerization in accordance with the prior art. In the context of the present invention, however, it is advantageous to utilize the total crude hydrogenation product in the isomerization reaction. The isomerization is carried out in the presence of a variety of acidic catalysts such as the Brönsted or Lewis acids. The Lewis acids and specifically, aluminum chloride, are preferred from the standpoint of inducing a rapid reaction rate. On the other hand, aluminum chloride has a tendency to cause the isomerization to proceed beyond the exo isomer thereby resulting in the objectionable formation of substantial amounts of transdecalin and adamantane. Accordingly, due care must be exercised in the utilization of this catalyst.

The extent of conversion to the exo isomer can be conveniently monitored by vapor liquid gas chromatography. Upon attaining substantially complete conversion; i.e., 98+%, the reaction mixture is cooled to about 80° C. to provide, upon settling, a two-phase system thereby permitting recovery of the fuel from the sludge by decantation. The product is then fractionally distilled to provide a heartcut which consists essentially of the exo isomers. If the crude hydrogenation product is employed in effecting the isomerization reaction, a forecut of the isomerization reaction product will be essentially composed of isomeric pentanes with the major portion thereof, i.e., about 70 percent, being cyclopentane. This forecut represents an effective flash point depressant in accordance with this invention and is especially suited for this purpose. Other alkanes applicable for use in the practice of this invention include cyclopropane, butane and mixtures thereof.

EXAMPLE

This example is illustrative of the manner of modifying commercial JP-10 in accordance with this invention to achieve a lower Seta flash point without significantly diluting the net heat content thereof. The flash point depressants utilized were cyclopropane, butane and an isomeric mixture of pentanes. The results obtained are set forth in the following tables.

TABLE 1.

| PENTANES* IN JP-10 | | | | |
|---|---|---|---|---|
| Sample Number | Wt. % Pentanes* | Wt. % JP-10 | Flash Point (°F.) | Net Heat of Combustion BTU/gallon |
| 1 | 0.53 | 99.47 | 120 | 141,770 |
| 2 | 1.07 | 98.93 | 105 | 141,590 |
| 3 | 1.76 | 98.24 | 87 | 141,450 |
| 4 | 1.95 | 98.05 | 70 | 141,280 |
| 5 | 2.45 | 97.55 | 64 | 141,140 |
| 6 | 2.76 | 97.24 | 53 | 141,100 |
| 7 | 0.00 | 100.00 | 131 | 141,880 |

*Mixture of 10.5% Isopentane, 18.0% n-Pentane, and 71.5% Cyclopentane

TABLE 2.

| BUTANE IN JP-10 | | | | |
|---|---|---|---|---|
| Sample Number | Wt. % Butane | Wt. % JP-10 | Flash Point (°F.) | Net Heat of Combustion BTU/gallon |
| 1 | 0.16 | 99.84 | 120 | 141,810 |
| 2 | 0.35 | 99.65 | 84 | 141,740 |
| 3 | 0.53 | 99.47 | 69 | 141,660 |
| 4 | 0.91 | 99.09 | 31 | 141,510 |
| 5 | 0.00 | 100.00 | 132 | 141,880 |

TABLE 3.

| CYCLOPROPANE IN JP-10 | | | | |
|---|---|---|---|---|
| Sample Number | Wt. % Cyclopropane | Wt. % JP-10 | Flash Point (°F.) | Net Heat of Combustion BTU/gallon |
| 1 | 0.66 | 99.34 | <35 | 141,790 |
| 2 | 0.45 | 99.55 | 45 | 141,820 |
| 3 | 0.28 | 99.72 | 76 | 141,840 |
| 4 | 0.06 | 99.94 | 120 | 141,870 |
| 5 | 0.00 | 100.00 | 132 | 141,880 |

What is claimed is:

1. A high density liquid hydrocarbon fuel consisting essentially of from 99.9 to 95 weight percent of exo-tetrahydrodicyclopentadiene and correspondingly from 0.1 to 5.0 weight percent of a $C_3$–$C_7$ cyclic or acyclic alkane.

2. The hydrocarbon fuel according to claim 1 wherein said alkane is a pentane.

3. The hydrocarbon fuel according to claim 2 wherein said alkane is an isomeric mixture of pentanes containing a major amount of cyclopentane.

4. The hydrocarbon fuel according to claim 3 wherein said mixture of pentanes contains about 70% cyclopentane.

* * * * *